United States Patent [19]

Dyer

[11] 4,055,338

[45] Oct. 25, 1977

[54] DRILL STRING SHOCK ABSORBING APPARATUS

[75] Inventor: Billy F. Dyer, Houston, Tex.

[73] Assignee: Hughes Tool Company, Houston, Tex.

[21] Appl. No.: 658,217

[22] Filed: Feb. 17, 1976

[51] Int. Cl.[2] ..... E21B 17/02; F16F 9/18

[52] U.S. Cl. ..... 267/125; 64/23; 175/321; 308/4 A

[58] Field of Search ..... 267/65 R, 124, 125, 267/137; 64/23; 175/227-229, 320-322; 184/5, 100; 285/94; 308/4 A, 5 R, 6 A, 107, 123

[56] References Cited

U.S. PATENT DOCUMENTS

| | | | |
|---|---|---|---|
| 3,073,134 | 1/1963 | Mann | 64/23 |
| 3,122,902 | 3/1964 | Blair et al. | 64/23 |
| 3,225,566 | 12/1965 | Leathers | 64/23 |
| 3,244,459 | 4/1966 | Ortloff | 175/229 X |
| 3,382,936 | 5/1968 | Galle | 64/23 X |
| 3,383,126 | 5/1968 | Salvatori et al. | 175/321 X |
| 3,746,329 | 7/1973 | Galle | 267/125 |

*Primary Examiner*—Johnny D. Cherry
*Attorney, Agent, or Firm*—Robert A. Felsman

[57] ABSTRACT

Apparatus is disclosed for use in a drill string during rotary well drilling, especially of shallow holes such as blast holes, to absorb the shock loads imposed upon the drill bit and drill. A floating solid piston in an outer tubular body separates a gas chamber from a liquid chamber and equalizes the pressure between the two. A mandrel with large diameter bearing surfaces is carried reciprocally within the body, and has annular lubricating cavities separated from the liquid chamber. Lubricating passages include one in which a pressurized gas in a cavity supplies lubricant under pressure to the various bearing and sealing surfaces. Cylindrical pins inserted between the mandrel and the outer tubular body transmit torque between the body and mandrel.

9 Claims, 2 Drawing Figures

DRILL STRING SHOCK ABSORBING APPARATUS

BACKGROUND OF THE INVENTION

1. Field of the Invention

This invention relates to rotary well drilling, particularly to a shock absorbing apparatus placed in the drill string.

2. Description of the Prior Art

Shock absorbing apparatus is used to reduce the vibrations generated during rotary well drilling. One type of shock absorber is disclosed in U.S. Pat. No. 3,382,936, issued to the assignee of Edward M. Galle. It uses gas as the shock absorbing medium and a liquid separated from the gas by a flexible wall separator or compensator. In U.S. Pat. No. 3,746,329, Galle discloses a solid piston type separator that replaces the flexible wall separator and yet equalizes during drilling the pressure of the gas and liquid. This device is used for deep oil well drilling, during which the drilling mud transmits the borehole hydrostatic pressure to the liquid and gas in the shock absorber.

Another flexible separator or compensator is used to separate the drilling mud and lubricant inside Galle's apparatus. If the separator ruptures or fails, the entire tool may fail since the abrasives normally present in the mud are extremely destructive.

The gas chamber in Galle's apparatus is long since hydrostatic pressure increases as the tool is lowered in a liquid filled borehole and causes compression of the gas. The large weights applied to the bit cause additional compression. It would be advantageous to shorten the length of a shock absorber used in blast hole drilling.

Normally in blast hole drilling the drilling fluid is air, and thus there is atmospheric but no hydrostatic pressure in the well bore. Because of small hole diameters, it is frequently advantageous to place the shock absorber above the hole at the drill. Consequently, the tool must be relatively short in comparison with the length of Galle's apparatus.

Also, the Galle apparatus if used in blast holes where air is the drilling fluid would experience large pressure differentials across the seals located between its body and reciprocal mandrel. Since the frictional pressure of a sliding seal is proportional with pressure differential across the seal, excessive heat might result, with consequent seal deterioration.

The splines used to transmit rotary motion from the tubular body to the reciprocable mandrel in the Galle apparatus are difficult to machine to that degree of accuracy required to prevent localized wearing and galling. Seals may be damaged in the presence of the metallic particles produced by such wearing or galling.

Since a shock absorber for blast hole operations would normally be operating above hole, it is desirable to have a provision for re-greasing the bearing areas without affecting the initial charge pressure in the gas cavity or disassembling the tool.

SUMMARY OF THE INVENTION

The improved shock absorber of the present invention has a reduced length that eliminates the separator or pressure compensator that separates, in the oil well drilling shock absorber, the drilling fluid from the interior fluids. A mandrel with relatively large diameter frictional bearings is used to enable the provision of a short, yet strong, shock absorber. The sealing system between the mandrel and housing uses axially spaced seals to contain a lubricant at a pressure intermediate the interior gas pressure and ambient pressure to minimize the pressure differential across the seals. This intermediate pressure is achieved by lubrication from a pressurized exterior source that pressurizes gas retained in a lubricant cavity located intermediate the seals. Rotary motion is transmitted between the mandrel and housing by drive pins that tend to be self-aligning to more evenly distribute loading and wear. Additional objects, features and advantages of the invention will become more fully apparent in the following description.

DESCRIPTION OF THE PREFERRED EMBODIMENT

Figure 1:
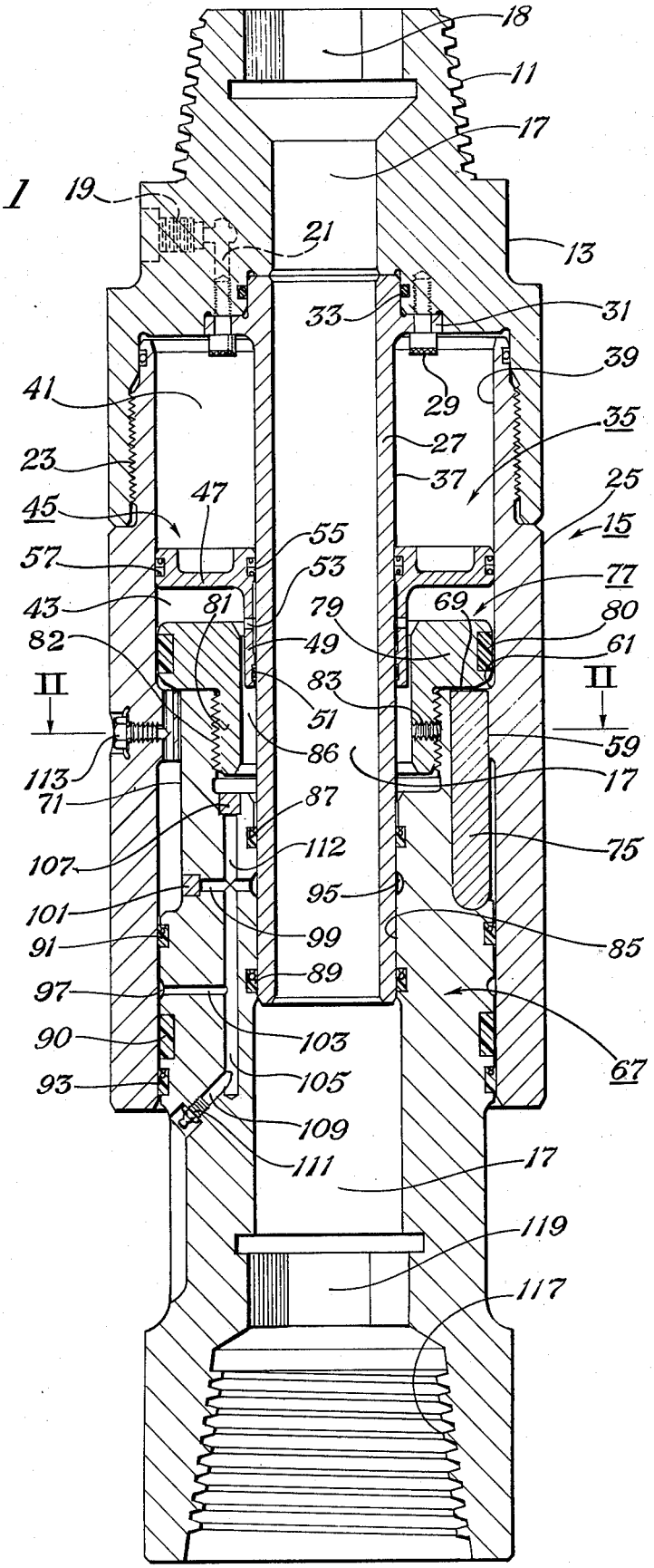
FIG. 1 is a side elevational view in longitudinal section, along the lines I—I of FIG. 2, of a shock absorbing apparatus constructed according to the principles of the invention.

Referring initially to FIG. 1, a threaded portion 11 protrudes from a top sub 13 that forms a portion of an outer tubular body 15 that is thus adapted for attachment to a drill string member such as drill steel or a kelly (not shown). An axial passage 17 extends through the top sub for transmitting a drilling fluid to a drill bit from suitable surface equipment (not shown). The upper portion 18 of passage 17 is hexagonally formed for use in assembly of the tool.

A charging port and valve means 19 is carried by the top sub 13 for introducing a gas under selected pressure into the apparatus. The valve may be similar to that shown in U.S. Pat. No. 3,382,936, and functions generally the same as the valve used in a conventional automobile tire. The valve thus extends through the top sub 13 of tubular body 15, and into a subsequently described gas region to enable selective variation of the charging pressure. A passage 21 extends toward the interior of top sub 13. Threads 23 are utilized to secure the top sub 13 to barrel 25 of tubular body 15.

Coaxially secured inside barrel 25 to the top sub 13 and forming a part of the outer tubular body 15, is an inner tubular member 27. Inner tubular member 27 is retained by cap screws 29 that extend through a flanged portion 31 of the inner tubular member 27, which also forms a continuation of axial passage 17. An O-ring seal 33 is located between top sub 13 and inner tubular member 27.

An annular sealed chamber or cavity 35 is formed between the exterior annular surface 37 of the tubular member 27 and an interior annular surface 39 of the barrel 25. The cavity 35 is divided between a gas region 41 and a liquid region 43 by a movable annular piston-type separator 45. The piston 45 is adapted to move axially responsive to pressure differential between gas region 41 and liquid region 43 for the purpose of equalizing the pressure between the two regions.

In its preferred form the piston-type separator 45 is constructed of a solid, fluid impervious material of generally tubular configuration with an enlarged region 47, and an elongated region 49 that projects downward. Elongated region 49 is cylindrical with a wiper ring 51 that is preferably of "Teflon" received in a groove formed in a slightly enlarged portion that extends inwardly beyond the inner wall of elongated region 49. The purpose of the wiper ring is to prevent metal to metal contact with the exterior annular surface 37 of inner tubular member 27 to lessen wear.

A plurality of radially drilled holes 53 are formed through region 49 adjacent the enlarged region 47 of separator 45 of the piston to permit the interchange of lubricant to effect better lubrication of the various seal rings. Enlarged region 47 has an inner seal means 55 and outer seal means 57 located in a groove and comprises a pair of seal rings. The preferred seals are resilient seals of 90 Durometer hardness. They may be "molythane" seals manufactured by Parker Seal Company.

Figure 2:
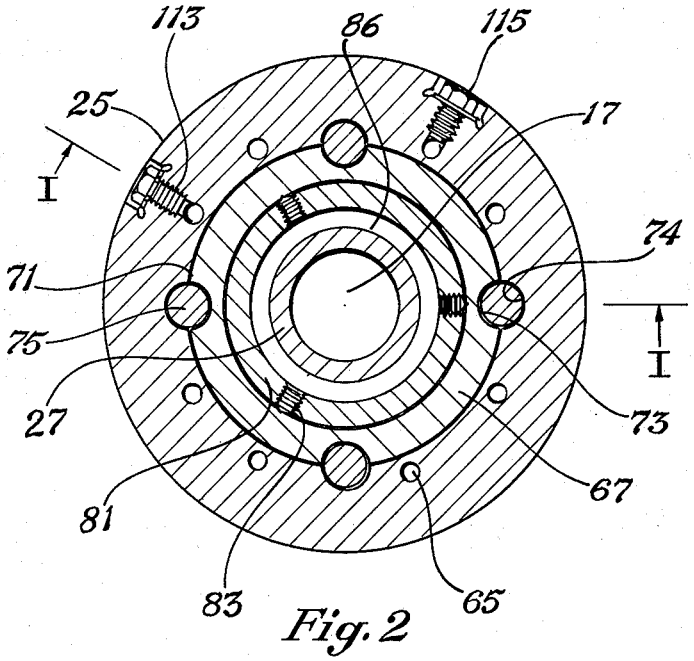
FIG. 2 is a cross-sectional view as seen looking along the lines II—II of FIG. 1.

Near the mid-portion of barrel 25, a band 59 extends inwardly from the interior annular surface 39. Band 59 protrudes inwardly to form a shoulder 61 on its upper edge. Referring to FIG. 2, four longitudinal, semicircular grooves 74 are spaced evenly around band 59. Several longitudinal passages 65 (see FIG. 2) are formed through band 59.

A mandrel 67 is located below piston type separator 45 in sliding and reciprocating engagement with the tubular body 15. The upper surface 69 of mandrel 67 is flat and annular and joins with an exterior annular surface 71 facing band 59. Longitudinal, semicircular grooves 73 (see FIG. 2) are formed in mandrel 67 adjacent mating grooves 74 in the barrel 25, thereby forming cylindrical passages. Preferably tool steel pins 75, about 6 inches in length, are inserted in the passages to transmit rotary motion from the outer tubular body 15 to mandrel 67.

A retainer ring 77 is coupled to the upper surface 69 of mandrel 67, and has an enlarged region 79 that engages the interior surface 39 of barrel 25, preferably with a "Teflon" band 80. Retainer ring 77 has an annular elongated region 81 connected with threads 82 to mating threads in an upper portion of mandrel 67. Inner tubular member 27 extends downwardly through an axial passage 86 of the retainer ring 77 into the mandrel 67. The inner diameter of retainer ring 77 is sufficiently large to reciprocably receive the elongated region 49 of piston separator 45. The external surface 37 of inner tubular member 27 is in sliding contact with the interior annular surface 85 of mandrel 67. The large diameter portion or enlarged region 74 is larger in diameter than the band 59 at the grooves 74, thus rests on shoulder 61 in the fully extended position to prevent the mandrel 67 from separating from tubular body 15.

A primary inner load seal 87 is located in an annular groove in the interior annular surface 85 of the mandrel 67 for sealing pressurized fluid in the liquid region 43 of cavity 35. A secondary inner seal 89 is located in a groove in the annular surface 85 of mandrel 67 below the primary load seal 87. Seal 89 will be adjacent the bottom of tubular member 27 when the mandrel 67 is at its lowermost position relative to outer tubular body 15. The exterior surface of mandrel 67 below grooves 73 is in sliding contact with inner annular surface 39 of barrel 25. Friction is preferably minimized by "Teflon" band 90. An outer primary load seal 91 is located in a groove on the exterior surface of the mandrel above "Teflon" band 90. A secondary outer load seal 93 is located below "Teflon" band 90. Seal 93 will be adjacent the bottom of barrel 25 when the mandrel 67 is fully extended to its lowest point. Seals 87, 89, 91 and 93 are single resilient seals, preferably "molythane" seals.

An annular groove or inner lubricant cavity 95 is formed in the interior surface 85 of mandrel 67 between inner load seals 87 and 89. Similarly an outer annular groove, or outer lubricant cavity 97 is formed on the exterior of mandrel 67 between outer seals 91 and 93. The lubricant cavities include the annular clearance space between the primary and secondary seals. A lateral passage 99 is drilled from the exterior of mandrel 67 to inner lubricant cavity 95 and then sealed by steel plug 101. A lateral passage 103 is drilled inwardly a selected distance from lubricant cavity 97. A longitudinal passage 105 is drilled in the mandrel, intersecting passages 99 and 103, to a depth adjacent outer secondary seal 93. A steel plug 107 seals off the entrance to passage 105. An inclined passage 109 is drilled from the exterior of mandrel 67 from a point below the bottom of barrel 25 to the bottom of longitudinal passage 105. Grease fitting means 111 is threaded into inclined passage 109. Grease fitting 111 is of a conventional type that allows the introduction of grease or lubricant under pressures, preferably those exceeding 500 psi. Passages 99, 103, 105 and 109 serve as passage means for supplying lubricant to the inner and outer grease grooves or cavities 95, 97. The portion 112 of longitudinal passage 105 from steel plug 107 to the intersection of lateral passage 99 serves as pressurized gas cavity means to provide positive pressurization of the lubricant.

A lubricant charging hole and sealing plug 113 are located in barrel 25 adjacent grooves 74 in communication with passages 65 and liquid cavity 43. A bleeder hole and plug 115 (see FIG. 2) are also in communication with passages 65 for bleeding trapped air out during filling. The mandrel terminates in a threaded portion 117, which may be secured to a drill string member. The bottom of axial passage 17 has a hexagonal portion 119 used during assembly of the apparatus.

After assembly of the apparatus, a gas such as nitrogen is introduced to the gas region 41 of annular sealed cavity 35 through the charging port 19 and passage 21. The gas is pressurized to a selected pressure of, for example, 700 psi. A liquid, which may be conventional hydraulic oil, is then introduced through charge port 113, while trapped air is bled out through bleeder hole 115 (see FIG. 2). The liquid fills liquid region 43, including the various passages and spaces that communicate with the cavity. Since the piston 45 is free to move axially, responsive to pressure differentials between the gas in gas region 41 and liquid region 43, the pressure will be equalized between the two cavities.

A lubricant, such as molybdenum-based grease, is introduced through grease fitting 111 and associated passages into the inner and outer lubricant cavities or grooves 95, 97. As the lubricant travels through passages 109, 103 and 105, air (gas) will be forced into pressurized gas cavity means 112. Lubricant is injected until a selected pressure is achieved, for example, 500 psi. Primary load seals 87, 91 prevent the liquid in liquid region 43 of cavity 35 from entering the lubricant grooves 95, 97. The pressure differential across the primary load seals will be the liquid-gas cavity 35 pressure less the lubricant cavity pressure, or approximately 200 psi under the above examples. Secondary load seals 89, 93 prevent lubricant from leaking to the atmosphere.

In operation, the thread portion 11 of top sub 13 is connected with the kelly or upper drill member. The threads 117 of mandrel 67 are connected with a depending drill string member that supports the drill bit. Applying weight or force to the bit causes increased pressure of the liquid in liquid region 43. The resulting pressure differential across piston separator 45 causes its upward movement and compression of the gas in gas region 41 of cavity 35 until the pressures are equalized. Shock loadings are dampened by the compression of the gas in gas region 41.

It should be apparent from the foregoing that an apparatus having significant advantages has been provided. The apparatus can be sufficiently short to enable convenient use to drill shallow holes such as in raise drilling. The use of a retainer ring attached to the mandrel to engage the interior of the tubular housing results in great strength in a short length. The sealing system using a pressurized gas cavity means enables a lubricant pressure intermediate the pressure of the fluid inside the apparatus and the ambient pressure. As a consequence, the pressure differential across each seal is minimized. Rotary motion is transmitted from housing to mandrel by drive pins that are easier to manufacture than splines and tend to be self-aligning for more even wear distribution.

While the invention has been shown in only one of its forms, it should be apparent to those skilled in the art that it is not so limited but is susceptible to various changes and modifications without departing from the spirit thereof.

I claim:

1. In a shock absorbing apparatus for use in a drill string, including a tubular body adapted to be secured to a drill string member; a mandrel reciprocally mounted to the tubular body for rotation therewith and and having a portion adapted to be secured to another drill string member; drilling fluid passage means within the tubular body and the mandrel for the passage of drilling fluid; and an annular sealed chamber within the tubular body above the mandrel containing pressurized fluid for absorbing load and shock, the improvement which comprises in combination:

annular and axially spaced seals between the mandrel and a lower portion of the tubular body to define a lubricant cavity sealed from the chamber to lubricate said seals;

lubricant passage means for supplying lubricant from an exterior source to said lubricant cavity;

and grease fitting means communicating with said lubricant cavity to introduce and retain lubricant within said lubricant passages and cavity at a selected pressure greater than ambient.

2. In a shock absorbing apparatus for use in a drill string, including a tubular body adapted to be secured to a drill string member, a mandrel reciprocally mounted to the tubular body for rotation therewith and having a portion adapted to be secured to another drill string member, said mandrel being adapted to bear against the tubular body; axial passages within the tubular body and the mandrel for the passage of drilling fluid; and an annular sealed chamber within the tubular body above the mandrel containing pressurized fluid for absorbing load and shock, the improvement which comprises in combination:

annular and axially spaced seals between the mandrel and a lower portion of the tubular body to define an outer lubricant cavity to lubricate said seals;

a tubular member carried by the tubular body and inserted in telescoping relationship within the axial passage in the mandrel;

annular and axially spaced inner seals between the axial passage in the mandrel and the tubular member to define an inner lubricant cavity to lubricant said inner seals;

lubricant passage means for supplying lubricant from an exterior source to said inner and outer lubricant cavities and providing communication between said inner and outer lubricant cavities;

and grease fitting means to introduce and retain lubricant within said lubricant passages and cavities.

3. In a shock absorbing apparatus for use in a drill string, including a tubular body adapted to be secured to a drill string member; a mandrel reciprocally mounted to the tubular body for rotation therewith and having a portion adapted to be secured to another drill string member, said mandrel being adapted to bear against the tubualr body; drilling fluid passage means within the tubular body and the mandrel for the passage of drilling fluid; and an annular gas and liquid chamber within the tubular body above the mandrel; the improvement which comprises in combination:

annular and axially spaced outer seal means between the mandrel and a lower portion of the tubular body to define an outer lubricant cavity sealed from the annular gas and liquid chamber to lubricate said outer seal means;

lubricant passage means for supplying lubricant from an exterior source to said outer lubricant cavity;

and grease fitting means to retain lubricant within said lubricant passages and cavity when disconnected from the exterior source of lubricant;

said lubricant being introduced and retained under a pressure greater than ambient pressure.

4. In a shock absorbing apparatus for use in a drill string, including a tubular body adapted to be secured to a drill string member; a mandrel reciprocally mounted to the tubular body for rotation therewith and having a portion adapted to be secured to another drill string member, said mandrel being adapted to bear against the tubular body; drilling fluid passage means within the tubular body and the mandrel for the passage of drilling fluid; and an annular sealed chamber within the tubular body above the mandrel containing pressurized fluid for absorbing load and shock, the improvement which comprises in combination:

annular and axially spaced outer seal means between the mandrel and a lower portion of the tubular body to define an outer lubricant cavity to lubricate said outer seal means;

lubricant passage means for supplying lubricant from an exterior source to said outer lubricant cavity;

and grease fitting means to retain lubricant within said lubricant passages and cavity when disconnected from the exterior source of lubricant;

said lubricant being under a pressure less than the pressure within the chamber, but substantially greater than atmospheric pressure to define a first pressure differential from the chamber to the lubricant cavity and a second pressure differential from the lubricant cavity to atmosphere.

5. In a shock absorbing apparatus for use in a drill string, including a tubular body adapted to be secured to a drill string member; a mandrel reciprocally mounted to the tubular body for rotation therewith and having a portion adapted to be secured to another drill string member, said mandrel being adapted to bear against the tubular body; drilling fluid passage means with the tubular body and the mandrel for the passage of drilling fluid; and an annular sealed chamber within the tubular body above the mandrel containing pressurized fluid for absorbing load and shock, the improvement which comprises in combination:

annular and axially spaced outer seal means between the mandrel and a lower portion of the tubular body to define an outer lubricant cavity to lubricate said outer seal means;

lubricant passage means for supplying lubricant from an exterior source to said outer lubricant cavity;

grease fitting means to retain lubricant within said lubricant passages and cavity when disconnected from the exterior source of lubricant;

and pressurized gas cavity means within the lubricant passage means for providing space to compress gases trapped by lubricant injected under pressure;

said lubricant being under a pressure less than the annular sealed chamber pressure, but substantially greater than atmospheric pressure whereby the overall difference in pressure from the annular sealed chamber to the atmosphere drops in two stages.

6. In a shock absorbing apparatus for use in a drill string, including a tubular body adapted to be secured to a drill string member; a mandrel reciprocally mounted to the tubular body for rotation therewith and having a portion adapted to be secured to another drill string member, said mandrel being adapted to bear against the tubular body; drilling fluid passage means within the tubular body and the mandrel for passage of drilling fluid; and an annular sealed chamber within the tubular body above the mandrel containing pressurized fluid for absorbing load and shock, the improvement which comprises in combination:

a plurality of longitudinal grooves on the exterior annular surface of the mandrel;

a plurality of longitudinal grooves on the interior annular surface of the tubular body mating with the mandrel grooves to define cylindrical cavities;

pins inserted within the cylindrical cavities for torque transmission;

a retainer ring secured to the mandrel and having a large diameter portion adjacent the top of the pins that engages the interior of the tubular body; the large diameter portion of the retainer ring being larger than the diameter of the tubular body at the grooves, thereby retaining the mandrel in the tubular body and the pins within the cylindrical cavities.

7. In a shock absorbing apparatus for use in a drill string, including a tubular body adapted to be secured to a drill string member; a mandrel reciprocally mounted to the tubular body for rotation therewith and having a portion adapted to be secured to another drill string member, said mandrel being adapted to bear against the tubular body; drilling fluid passage means within the tubular body and the mandrel for passage of drilling fluid; a gas and liquid chamber within the tubular body above the mandrel; and a fluid impervious floating piston dividing the chamber into gas and liquid regions, the improvement which comprises in combination:

a plurality of longitudinal grooves on the exterior annular surface of the mandrel;

a plurality of longitudinal grooves on the interior annular surface of the tubular body mating with the mandrel grooves to define cylindrical cavities;

pins inserted within the cylindrical cavities for torque transmission;

a retainer ring having an axial passage and coupled to the top of the mandrel adjacent the tops of the pins for retaining them; the exterior annular surface of the retainer ring adapted to bear against the tubular body; and a tubular member carried at its top by the tubular body and inserted in telescoping relationship within the drilling fluid passage means in the mandrel and the axial passage in the retainer ring; the axial passage being larger in diameter than the tubular member by a selected amount to define an annular space between the retainer ring and tubular member;

the piston having an enlarged annular region with exterior and interior resilient sealing rings, and an elongated region adapted for reception within the annular space.

8. In a shock absorbing apparatus for use in a drill string, including a tubular body adapted to be secured to a drill string member; a mandrel reciprocally mounted to the tubular body for rotation therewith and having a portion adapted to be secured to another drill string member, said mandrel being adapted to bear against the tubular body; axial passages within the tubular body and the mandrel for the passage of drilling fluid; and an annular sealed chamber within the tubular body above the mandrel containing pressurized fluid for absorbing load and shock, the improvement which comprises in combination:

annular and axially spaced seal means between the mandrel and a lower portion of the tubular body to define an outer lubricant cavity to lubricate said seal means;

a tubular member carried at its top by the tubular body and inserted in telescoping relationship within the axial passage in the mandrel;

annular and axially spaced inner seal means between the axial passage in the mandrel and the tubular member to define an inner lubricant cavity to lubricate said inner seal means;

lubricant passage means for supplying lubricant from an exterior source to said inner and outer lubricant cavities and communicating said inner and outer lubricant cavities with each other;

grease fitting means to retain lubricant within said lubricant passages and cavities when disconnected from the exterior source of lubricant;

gas cavity means within the lubricant passage means for providing space to compress gases trapped by lubricant injected under pressure; said lubricant being under a pressure less than the annular sealed chamber pressure, but substantially greater than atmospheric pressure;

a plurality of longitudinal grooves on the exterior annular surface of the mandrel;

a plurality of longitudinal grooves on the interior annular surface of the tubular body mating with the mandrel grooves to define cylindrical cavities;

pins inserted within the cylindrical cavities for torque transmission; and a retainer ring coupled to the top of the mandrel, its annular exterior surface adapted to bear against the tubular body, and its lower surface adjacent the tops of the pins for retaining them.

9. In a shock absorbing apparatus for use in a drill string, including a tubular body adapted to be secured to a drill string member, a mandrel reciprocally mounted to the tubular body for rotation therewith and having a portion adapted to be secured to another drill string member, said mandrel being adapted to bear against the tubular body; axial passages within the tubular body and the mandrel for the passage of drilling fluid; and an annular gas and liquid chamber within the tubular body above the mandrel for absorbing load and shock, the improvement which comprises in combination:

annular and axially spaced seals between the mandrel and a lower portion of the tubular body to define an outer lubricant cavity to lubricate said seals;

a tubular member carried by the tubular body and inserted in telescoping relationship within the axial passage in the mandrel;

annular and axially spaced inner seals between the axial passage in the mandrel and the tubular member to define an inner lubricant cavity to lubricate said inner seals;

lubricant passage means for supplying lubricant from an exterior source to said inner and outer lubricant cavities and providing communication between said inner and outer lubricant cavities;

and means to introduce and retain lubricant within said lubricant passages and cavities; said lubricant being under a pressure less than the pressure within the gas and liquid chamber, but substantially greater than atmospheric pressure to define a first pressure differential from the gas and liquid chamber to the lubricant cavity and a second pressure differential from the lubricant cavity to atmosphere.

* * * * *

UNITED STATES PATENT OFFICE

CERTIFICATE OF CORRECTION

Patent No. 4,055,338 Dated October 25, 1977

Inventor(s) Billy F. Dyer

It is certified that error appears in the above-identified patent and that said Letters Patent are hereby corrected as shown below:

Column 3, Line 45, "74" is changed to --79--;

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*